US008129925B2

(12) United States Patent
Kojima et al.

(10) Patent No.: US 8,129,925 B2
(45) Date of Patent: Mar. 6, 2012

(54) TERMINAL DEVICE AND COMPUTER-READABLE STORAGE MEDIUM

(75) Inventors: Susumu Kojima, Higashiyamato (JP); Mitsuru Hamada, Tachikawa (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 603 days.

(21) Appl. No.: 12/291,698

(22) Filed: Nov. 13, 2008

(65) Prior Publication Data

US 2009/0121655 A1 May 14, 2009

(30) Foreign Application Priority Data

Nov. 13, 2007 (JP) ..... 2007-294019

(51) Int. Cl.
*H05B 37/02* (2006.01)

(52) U.S. Cl. ..... 315/307; 315/312; 315/360

(58) Field of Classification Search ..... 315/149, 315/291, 294, 297, 307–308, 312, 360; 345/102, 345/204

See application file for complete search history.

(56) References Cited

U.S. PATENT DOCUMENTS

| | | | | |
|---|---|---|---|---|
| 7,642,732 | B2 * | 1/2010 | Kominami et al. | 315/307 |
| 7,675,248 | B2 * | 3/2010 | Mubaslat et al. | 315/308 |
| 2007/0211013 | A1 * | 9/2007 | Uehara et al. | 345/102 |
| 2008/0018729 | A1 * | 1/2008 | Hamada | 348/14.01 |
| 2008/0157682 | A1 * | 7/2008 | Kwon | 315/154 |
| 2009/0134815 | A1 * | 5/2009 | Ye et al. | 315/294 |
| 2010/0156865 | A1 * | 6/2010 | Kreek et al. | 345/207 |
| 2010/0253239 | A1 * | 10/2010 | Hoover | 315/287 |
| 2010/0277444 | A1 * | 11/2010 | Lee et al. | 345/204 |

FOREIGN PATENT DOCUMENTS

| | | |
|---|---|---|
| JP | 08-327976 | 12/1996 |
| JP | 11-102173 | 4/1999 |
| JP | 11-344958 | 12/1999 |
| JP | 2001-215914 | 8/2001 |
| JP | 2002-123231 | 4/2002 |
| JP | 2003-037656 | 2/2003 |
| JP | 2006-041832 | 2/2006 |
| JP | 2006-171311 | 6/2006 |
| KR | 10-2005-77544 | 8/2005 |

* cited by examiner

*Primary Examiner* — Douglas W Owens
*Assistant Examiner* — Tung X Le
(74) *Attorney, Agent, or Firm* — Cozen O'Connor

(57) ABSTRACT

A terminal apparatus and a computer-readable storage medium capable of achieving reduction of power consumption by appropriately controlling lighting of a display unit are provided.

A CPU lights or extinguishes a display unit after the end of an interrupt event in accordance with a lighting state (lighting, dim-lighting, being unlighted) of the display unit when the occurrence of the interrupt event is detected. It is therefore possible for the CPU to perform appropriate display control according to the lighting state when an interrupt event occurs.

8 Claims, 11 Drawing Sheets

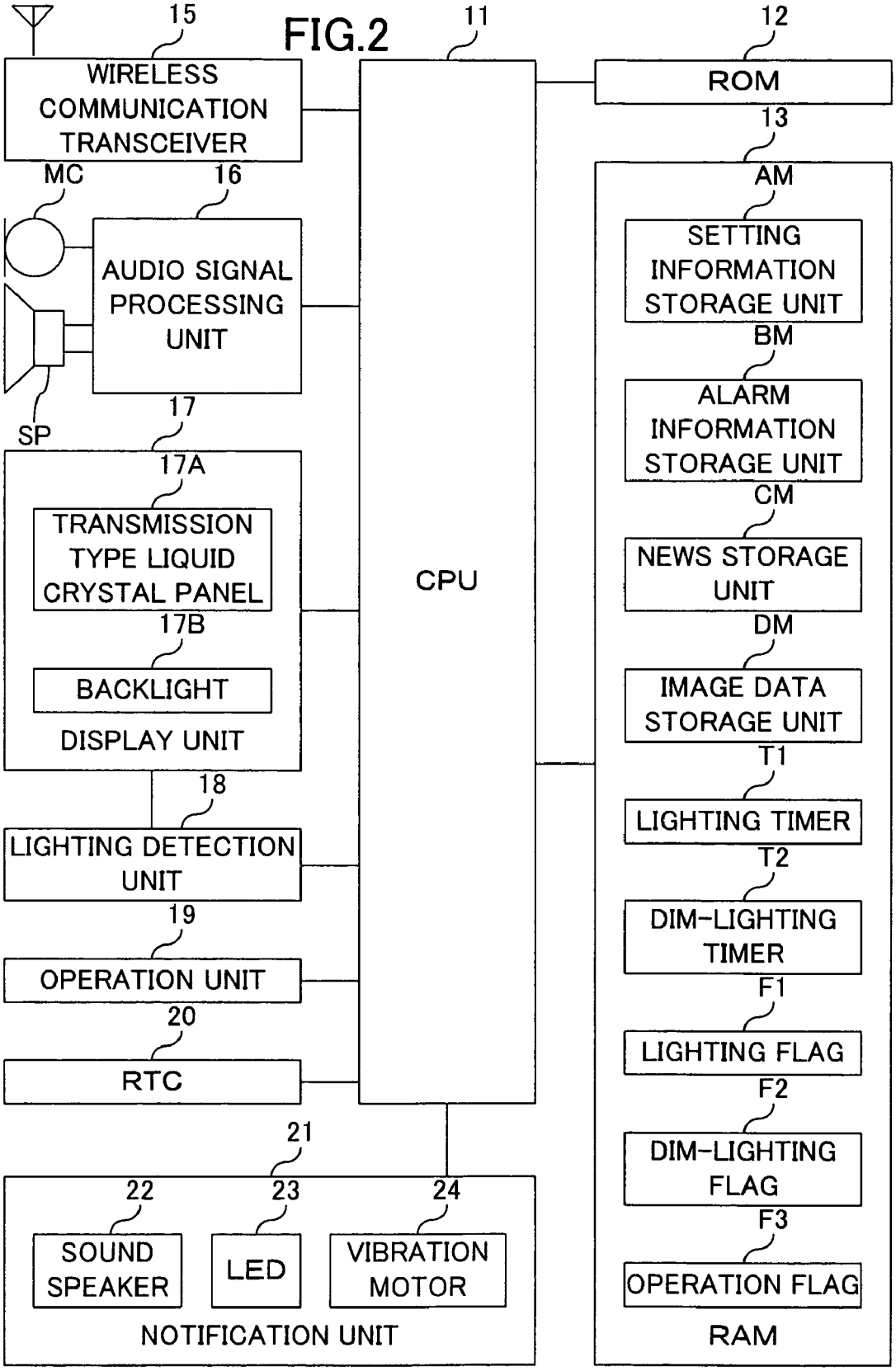
FIG.2
15
WIRELESS COMMUNICATION TRANSCEIVER
MC
16
AUDIO SIGNAL PROCESSING UNIT
SP
17
17A
TRANSMISSION TYPE LIQUID CRYSTAL PANEL
17B
BACKLIGHT
DISPLAY UNIT
18
LIGHTING DETECTION UNIT
19
OPERATION UNIT
20
RTC
11
CPU
12
ROM
13
AM
SETTING INFORMATION STORAGE UNIT
BM
ALARM INFORMATION STORAGE UNIT
CM
NEWS STORAGE UNIT
DM
IMAGE DATA STORAGE UNIT
T1
LIGHTING TIMER
T2
DIM-LIGHTING TIMER
F1
LIGHTING FLAG
F2
DIM-LIGHTING FLAG
F3
OPERATION FLAG
RAM
21
22
23
24
SOUND SPEAKER
LED
VIBRATION MOTOR
NOTIFICATION UNIT

FIG.3

SETTING INFORMATION

AM

| ITEM | TIME |
|---|---|
| LITGHING TIME | TEN SECONDS (ZERO SECOND TO SIXTY SECONDS) |
| DIM-LIGHTING TIME A | THIRTY MINUTES (ZERO MINUTE TO NINETY MINUTES) |
| DIM-LIGHTING TIME B | ONE MINUTE (ZERO MINUTE TO FIVE MINUTES) |

TERMINAL DEVICE AND COMPUTER-READABLE STORAGE MEDIUM

BACKGROUND OF THE INVENTION

1. Field of the Invention

The present invention relates to a terminal device and a computer-readable storage medium that control brightness of a display unit.

2. Description of the Related Art

In addition to light-emitting display devices such as organic EL (Light Emitting) display panels and liquid crystal display panels, display devices equipped with backlights (illuminating lights) are also utilized in terminal apparatuses such as mobile telephones. Terminal apparatuses also controls brightness according to the type of display device. For example, Unexamined Japanese Patent Application KOKAI Publication No. H08-327976, discloses a transmission-type liquid crystal panel where a backlight goes out after a predetermined period of time elapses from when the backlight for illumination is lighted up. The content of Unexamined Japanese Patent Application KOKAI Publication No. H08-327976 is taken to be incorporated in this specification.

SUMMARY OF THE INVENTION

Terminal apparatuses utilizing reflective-type liquid crystal panels carry out displaying by utilizing external light. Users can therefore visually check display content even when an illuminating light is unlighted, such as, for example, during standby. On the other hand, with terminal apparatuses utilizing transmission-type liquid crystal panels, when an illuminating light is unlighted, it is not possible for a user to visually check the display content. Illumination is therefore carried out during standby using lighting less bright than the normal lighting (hereinafter referred to as "dim-lighting"). Terminal apparatuses utilizing such transmission-type liquid crystal panels achieve electrical power savings by switching over a lighting state between, for example, lighting during incoming voice calls and for during user operations, and being dim-lighting during the standby state or going from dim-lighting to being unlighted after a prescribed time period elapses. With terminal apparatuses utilizing the transmission-type liquid crystal panels explained above, "dim-lighting" corresponds to the "unlighted" of the reflective-type liquid crystal panels. However, unlike "unlighted", a substantial amount of electrical power is consumed if this state "dim-lighting" continues for a long time such as thirty minutes or one hour. In particular, in recent years, with terminal apparatuses such as mobile telephones where, in accompaniment with multiple functions, in addition to incoming calls and alarms, a large number of interrupt events occur such as the receipt of new news, lighting and dim-lighting is carried out every time an event occurs, which causes more power to be consumed.

In order to resolve the above problems, it is an object of the present invention to provide a terminal apparatus and a computer-readable storage medium capable of achieving power savings by appropriately controlling lighting of the display unit.

In order to achieve the above object, a terminal apparatus of a first aspect of the present invention is a terminal apparatus for controlling a display unit to be in a lighting state of at least one of lighting at a first brightness, lighting at a second brightness darker than the first brightness, and being unlighted, the terminal apparatus comprising an event detection unit that detects an occurrence of an interrupt event, a lighting detection unit that detects the lighting state of the display unit, and a lighting control unit that exerts control so that the lighting state of the display unit is either one of the second brightness or being unlighted after the end of the interrupt event by referring to the lighting state detected by the lighting detection unit when the occurrence of the interrupt event is detected by the event detection unit.

A computer-readable storage medium that stores a program for implementing the main functions of the terminal apparatus of the first aspect of the present invention explained above on a computer is also provided.

A terminal apparatus of a second aspect of the present invention is a terminal apparatus for controlling a display unit to be a lighting state of at least one of the lighting at a first brightness, lighting at a second brightness darker than the first brightness, and being unlighted, the terminal apparatus comprising a detection unit that detects a display state of the display unit, and a lighting control unit that controls a lighting time of the display unit at the second brightness by referring to the display state detected by the detection unit when lighting of the display unit at the first brightness ends and lighting at the second brightness begins.

A computer-readable storage medium that stores a program for implementing the main functions of the terminal apparatus of the second aspect of the present invention explained above on a computer is also provided.

According to the terminal apparatus of the first aspect of the present invention, it is possible to appropriately control lighting after the end of the interrupt event according to the lighting state of the display unit at the time of the occurrence of an interrupt event and it is possible to achieve power savings.

According to the terminal apparatus of the second aspect of the present invention, it is possible to appropriately control the lighting time at the second brightness according to the display state of the display unit at the time of the starting of lighting from the first brightness to the second brightness and power savings can also be achieved.

BRIEF DESCRIPTION OF THE DRAWINGS

These objects and other objects and advantages of the present invention will become more apparent upon reading of the following detailed description and the accompanying drawings in which:

FIG. 2 is a block diagram showing basic structural elements of a mobile telephone;

FIG. 3 is a diagram illustrating a setting information storage unit;

FIG. 4 is a flowchart showing the operation of a characteristic portion of a mobile telephone starting execution in accompaniment with power-on;

DETAILED DESCRIPTION OF THE PREFERRED EMBODIMENT

The following is a description of the embodiment of the present invention with reference to FIGS. 1 to 11.

Figure 1:
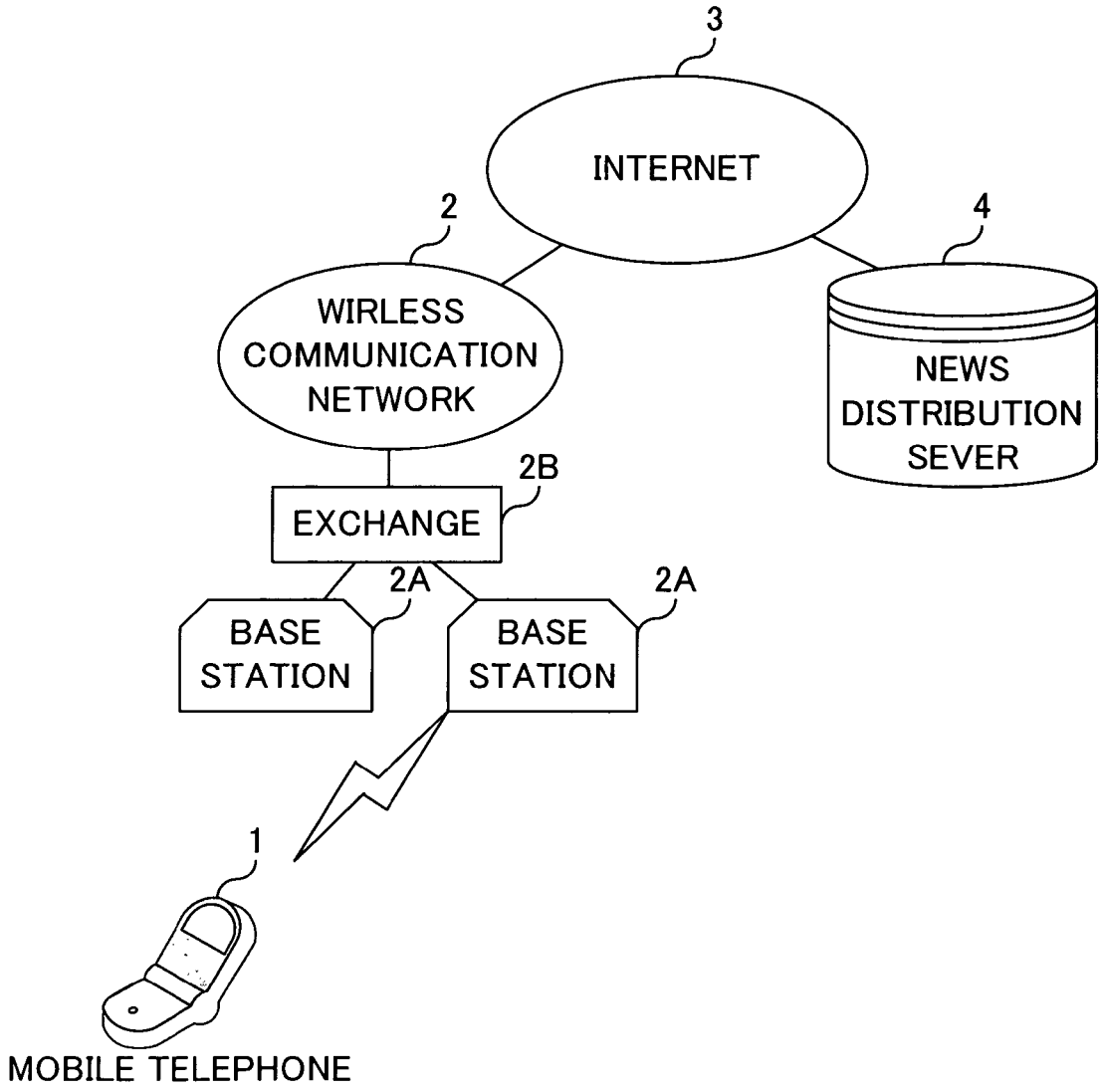
FIG. 1 is a block diagram showing a communication network system where a mobile telephone applicable as a terminal apparatus can be used.

FIG. 1 is a block diagram showing a communication network system where a mobile telephone applicable as a terminal apparatus can be used. A mobile telephone 1 is capable of making calls with other mobile telephones 1 via a mobile communication network (wireless communication network) 2 upon connecting with the mobile communication network 2 from a nearest base station 2A and an exchange 2B. Further, it is also possible to download news information distributed by a news distribution server 4 upon connecting to the news distribution server 4 via the mobile communication network 2 and an Internet 3. The news distribution server 4 is a supplier-side apparatus implementing a service of distributing news information to registered users either periodically, in emergencies, or according to user requirements.

FIG. 2 is a block diagram showing basic structural elements of the mobile telephone 1. A call function (voice call function), an e-mail function, an Internet connection function (Web access function), and alarm function etc. are provided at the mobile telephone 1. A CPU (Central Processing Unit) 11 is a central processing unit that controls the overall operation of the mobile telephone 1 according to each of the various programs within a ROM (Read Only Memory) 12. The ROM 12 has a program region and a data region, and a program for implementing this embodiment according to the operating procedure shown in FIG. 4 to FIG. 9 explained later is stored in the program region.

A RAM (Random Access Memory) 13 is an internal memory having a work region. In addition to a setting information storage unit AM explained later, the RAM 13 has an alarm information storage unit BM that stores alarm times and dates for an alarm etc., a news storage unit CM that stores news information distributed from the news distribution server 4, and an image data storage unit DM that stores image data such as a standby image (moving or still image). In addition to having a lighting timer T1 and a dim-lighting timer T2, the RAM 13 has a lighting flag F1, a dim-lighting flag F2, and an operation flag F3.

A wireless communication transceiver 15 is equipped with a wireless unit, a baseband unit, and a multiplexing/separating unit etc. and carries out transmission and receiving of data with the nearest base station 2A when, for example, the call function, the e-mail function, or the internet connection function etc. are operating. When a voice call is made, the wireless communication transceiver 15 takes in a signal from the receiving-side of the baseband unit and demodulates the signal to give a received baseband signal for output as audio from a call speaker SP via an audio signal processing unit 16. The wireless communication transceiver 15 then takes in audio data inputted from a talk microphone MC from the audio signal processing unit 16 and encodes the transmitted baseband signal. The wireless communication transceiver 15 then supplies the signal to the transmission side of the baseband unit and outputs a call from an antenna. Then, when the wireless communication transceiver 15 detects an incoming voice call or receives new news information distributed from the news distribution server 4, the detected incoming voice or the received news information is provided to the CPU 11 as an occurrence detection signal of an interrupt event.

A display unit 17 is equipped with a transmission type liquid crystal panel 17A and the illumination backlight 17B and is configured to display character data and image data etc. with high-definition. The backlight 17B is configured with a small fluorescent tube. Illuminating light is then irradiated from the back of the transmission type liquid crystal panel 17A by the lighting from the fluorescent tube. Control can be exerted to switch among "lighting", "dim-lighting", and "unlighted". "Lighting" indicates normal lighting (where the lighting level is bright: a first brightness). "Dim-lighting" indicates lighting at a lower brightness than the usual "lighting" (where the lighting level is dark: a second brightness) where the brightness is, for example, of about ¼ compared with "lighting".

A lighting detection unit 18 detects "lighting", "dim-lighting", and "unlighted" as lighting states of the display unit 17 (lighting conditions of the backlight 17B) and supplies a detection signal to the CPU 11. The CPU 11 controls the lighting state of the display unit 17 (lighting state of the backlight 17B) so that the backlight 17B is made to be "lighting" at the time of the occurrence of an interrupt event such as an incoming voice call or when new news is received, or at the time of a user operation. Further, the CPU 11 controls the lighting state of the display unit 17 (lighting state of the backlight 17B) so that the backlight 17B is "dim-lighting" or "unlighted" in order to suppress unnecessary consumption of electrical power when an interrupt event ends or when a prescribed time elapses from a user operation.

An operation unit 19 is equipped with various keys etc. and is for carrying out dial input, character input, or command input etc. The CPU 11 executes processing according to input signals from the operation unit 19. An RTC (Real Time Clock module) 20 is a clock unit. The CPU 11 acquires the current time and date from the RTC 20. A notification unit 21 is equipped with a sound speaker 22, an LED (Light-Emitting Diode) 23, and a vibration motor 24 etc. and in addition to being driven when there is an incoming call, is also driven at the time of an alarm notification such as when an alarm date and time is reached.

FIG. 3 is a diagram illustrating a setting information storage unit AM. The setting information storage unit AM is for storing various setting information set in advance in order to control the lighting state of the backlight 17B and can be set with "lighting time", "dim-lighting time A", or "dim-lighting time B". Default values are set for the items of "lighting time", "dim-lighting time A", "dim-lighting time B" in the setting information storage unit AM but it is also possible to arbitrarily change the default values according to user operations. The "lighting time" is an item where a time of lighting at the first brightness after a key operation (time for which the state in which there is no further key operation continues) is set. "Ten seconds" selected by a user operation from within the selection range of "zero seconds to sixty seconds" is set as the lighting time at the lighting time shown in FIG. 3.

"Dim-lighting time A", and "dim-lighting time B" are items where the lighting times at the second brightness are set. If the display state of the display unit 17 is a standby state or an image display state when switching over from "lighting" to "dim-lighting", the CPU 11 uses the "dim-lighting time A", but if the state is a state other than the standby state or image display state, the CPU 11 uses the "dim-lighting time B". "Thirty minutes" selected by the user from the selection range of "zero minute to ninety minutes" is set as the "dim-lighting time" at the "dim-lighting time A" shown in FIG. 3. Further, "one minute" selected by a user operation from within the selected range of "zero minute to five minute" is set as the dim-lighting time at the "dim-lighting time B". The setting of the "dim-lighting time A" to be longer than the "dim-lighting time B" is in order to make it possible to provide compatibility with cases such as, for example, where the displaying of moving images that tell a stories on the standby screen. Further, it is also possible to make selections taking into consideration usage conditions and power saving measures etc. of the mobile telephone 1 when selecting a desired time from a selection range.

Next, a description is given with reference to the flowcharts shown in FIG. 4 to FIG. 9 of the concept of the operation of the mobile telephone of this embodiment. Each of the functions explained in the flowcharts are stored in the form of computer-readable program code. Operations are executed sequentially at the mobile telephone 1 in accordance with this program code. The mobile telephone 1 is also capable of sequentially executing operations in accordance with the program code transmitted via a transmission medium. Namely, in addition to the storage medium, the mobile telephone can execute operations specific to this embodiment by utilizing a program/data supplied from outside via a transmission medium.

Figure 4:
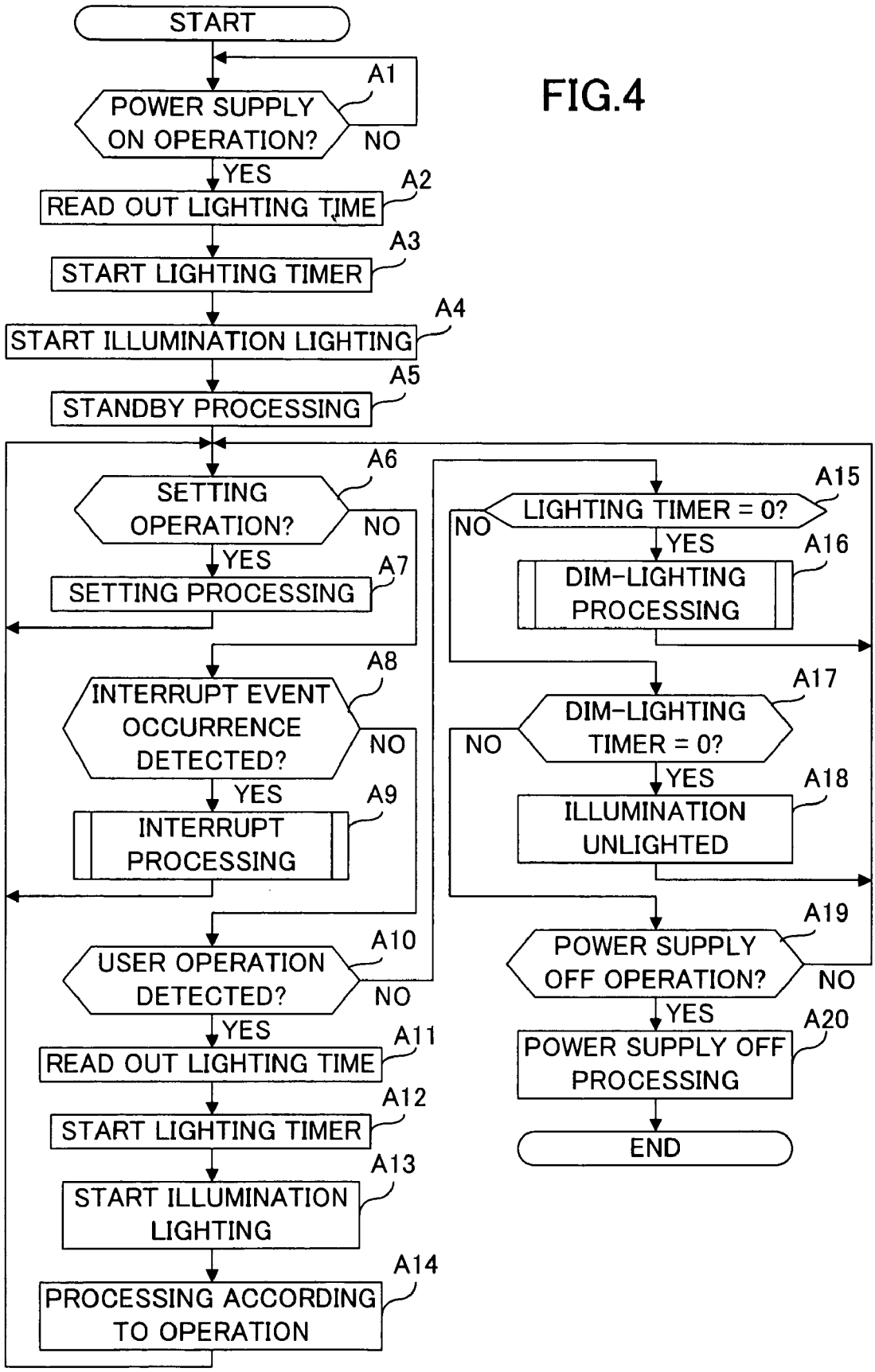

FIG. 4 is a flowchart showing the operation of a characteristic portion of a mobile telephone starting execution in accompaniment with power-on. First, when a power supply on operation is carried out to turn the power supply on (step A1, YES), the CPU 11 reads out the "lighting time" from the setting information storage unit AM (step A2). This "lighting time" is preset in the lighting timer T1 and the timer operation starts (step A3). Lighting of the backlight 17B is then started (step A4). The lighting timer T1 is, for example, a subtraction timer that sequentially subtracts from an initial value and performs a timer operation (subtraction operation) until a value of a preset "lighting time" becomes "0" (time out). The lighting timer T1 is not limited to being a subtraction timer, and can be constructed from an addition timer that sequentially adds to an initial value of "0".

Next, the CPU proceeds to standby processing where a standby state where incoming calls are awaited is entered while causing a wireless communication transceiver 15 to record the current position and display a prescribed standby image (step A5). When a setting operation instructing settings to the setting information storage unit AM is carried out in this standby state (step A6, YES), the CPU 11 proceeds to setting processing corresponding to this setting operation (step A7). First, in a state where the content of the setting information storage unit AM is read out by the CPU 11 and displayed as a list, when an item that is a target of change is selected or a desired time is selected from the selection range correlating to the selected item, this time is set to correlate to the selected item. In the standby state, at the time of an incoming voice call, the receipt of new news, or an alarm (when the day and time of an alarm is reached) at the wireless communication transceiver 15 is detected as the occurrence of an interrupt event (step A6, NO; step A8, YES), the CPU 11 proceeds to interrupt processing (step A9).

When a user operation is carried out in a standby state (step A8, NO; step A10, YES), the CPU 11 reads out the "lighting time" from the setting information storage unit AM (step A11). The "lighting time" is then put as a preset in the lighting timer T1 and a timer operation is started (step A12). Lighting of the backlight 17B of the display unit 17 is then started (step A13). The CPU 11 then proceeds to executing, for example, call processing for the voice call or e-mail processing etc. as processing corresponding to the operation (step A14). When the "lighting time" elapses and the lighting timer T1 times out in the standby state (step A15, YES), the CPU 11 proceeds to executing of dim-lighting processing explained in the following (step A16).

When the dim-lighting timer T2 times out (step A15, NO; step A17, YES), the CPU 11 extinguishes the backlight 17B (step A18). The dim-lighting timer T2 is, for example, a subtraction timer that sequentially subtracts from an initial value and performs a timer operation (subtraction operation) until the value of the preset "dim-lighting time" becomes "0" (time out). The dim-lighting timer T2 is not limited to being a subtraction timer, and can be constructed with an addition timer that sequentially adds to an initial value of "0". When a power supply off operation is carried out in the standby state (step A17, NO; step A19, YES), the CPU 11 proceeds to power supply off processing (step A20).

Figure 5:
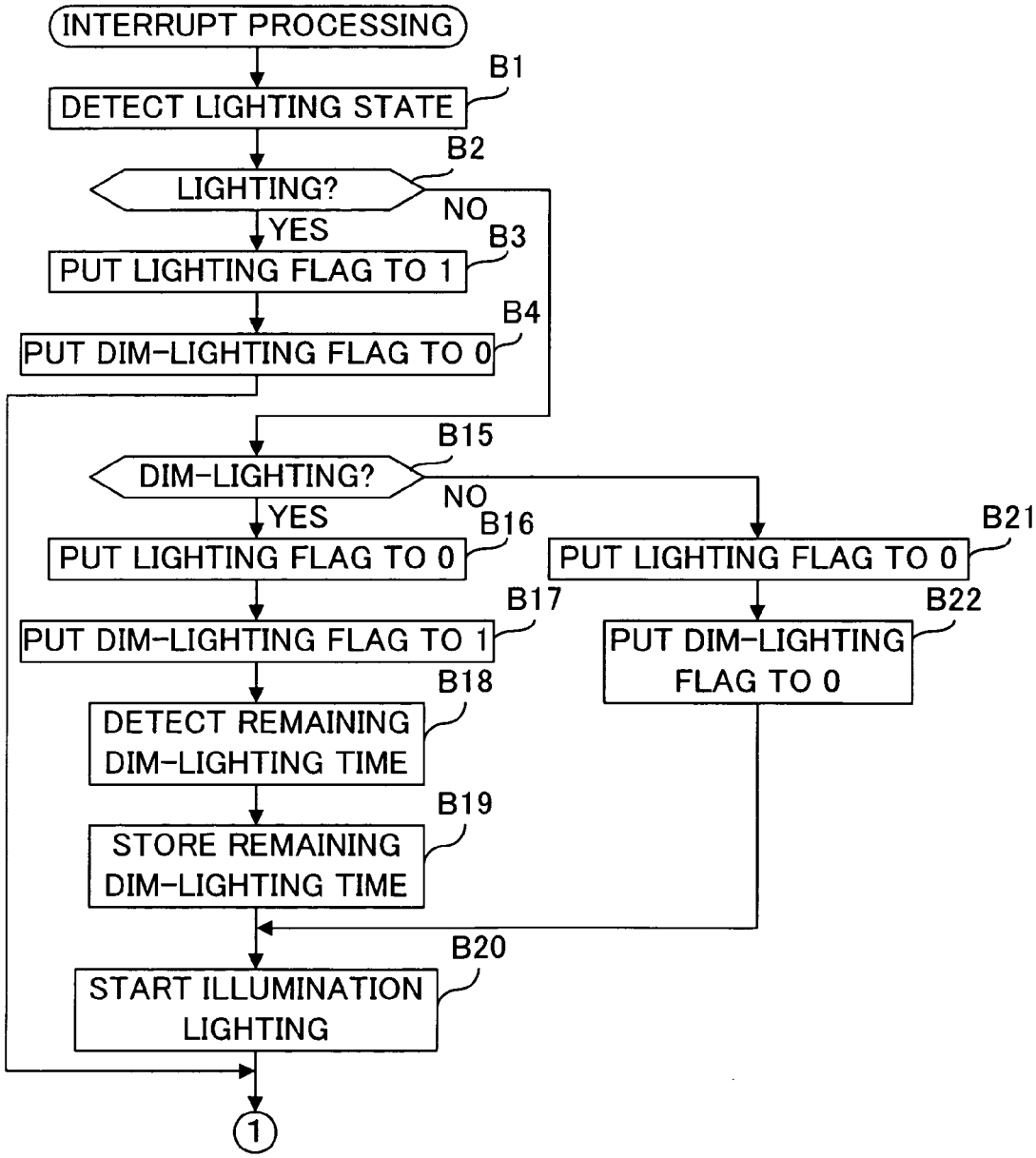
FIG. 5 is a flowchart describing the interrupt processing shown in FIG. 4.
Figure 6:
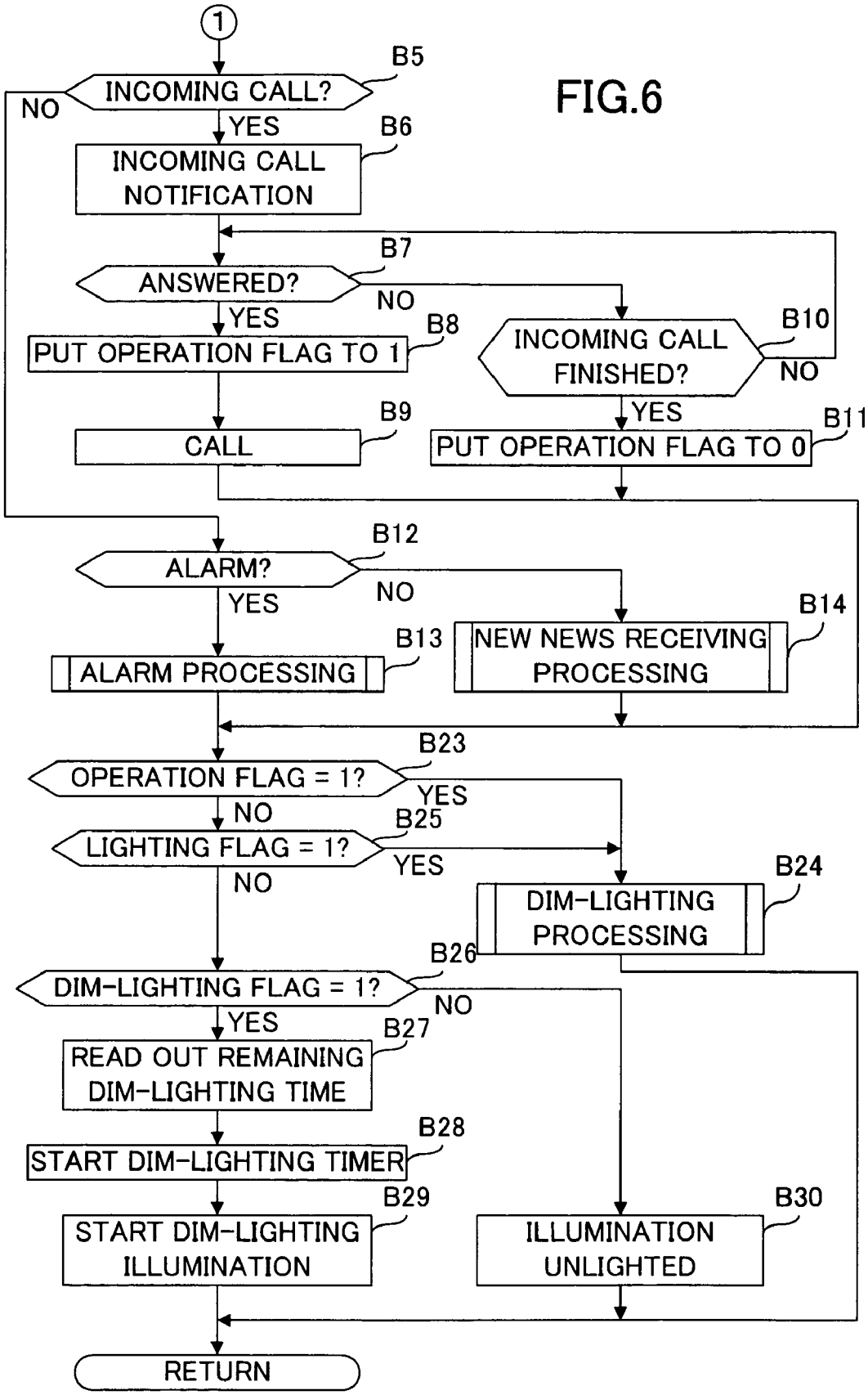
FIG. 6 is a flowchart of interrupt processing continuing on from FIG. 5.
Figure 10A:
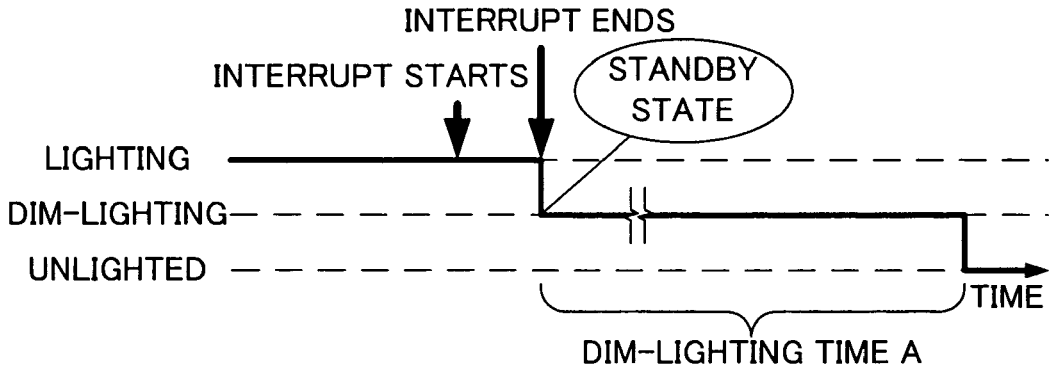
FIG. 10A is a time chart showing the lighting state of the backlight in the case where an interrupt occurs during the state of lighting.
Figure 10B:
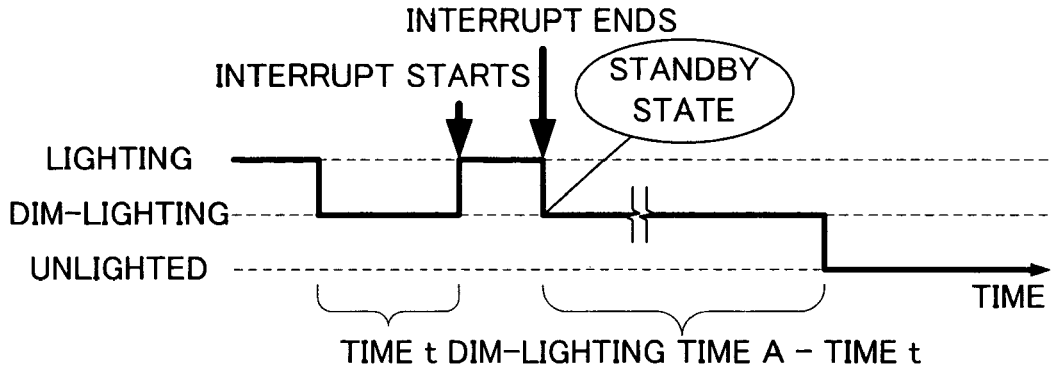
FIG. 10B is a time chart showing the lighting state of the backlight in accordance with passage of time, in the case where an interrupt occurs during the state of dim-lighting.
Figure 10C:
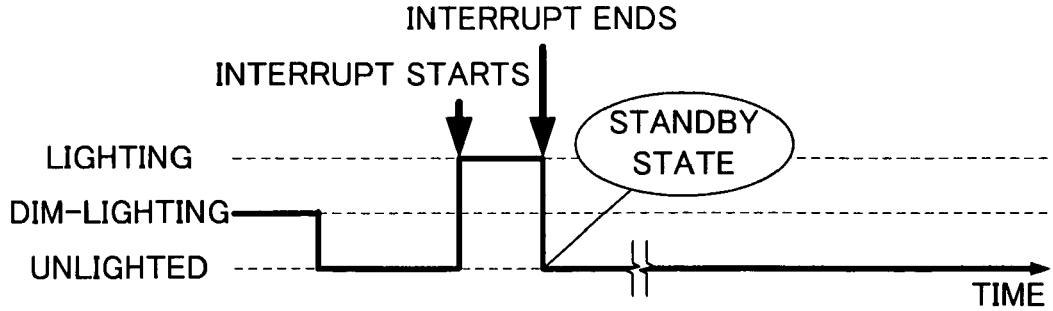
FIG. 10C is a time chart showing the lighting state of the backlight in accordance with passage of time, in the case where an interrupt occurs during the state of being unlighted.

FIGS. 5 and 6 are flowcharts describing the above-mentioned interrupt processing (step A9 of FIG. 4). In the following, a detailed description is given of the interrupt processing while referring to FIGS. 10A to 10C, 11A and 11B. FIGS. 10A to 10C are time charts showing the lighting state of the backlight 17B before and after the occurrence of an interrupt event, and in accordance with the passage of time. FIGS. 10A to 10C show how lighting state after the end of an interrupt is controlled according to the lighting state when the interrupt starts when the display state when the interrupt ends is a standby state. FIG. 10A is a time chart describing a case where an interrupt event occurs (start time) with the lighting state of the backlight 17B being "lighting", i.e. when there is an interrupt during lighting.

First, the CPU 11 accesses the lighting detection unit 18 and detects the lighting state of the backlight 17B when the interrupt starts (step B1 in FIG. 5). If currently lighting as shown in FIG. 10A (step B2, YES), the CPU 11 sets a lighting flag F1 to "1" for indicating being lighting (step B3) and sets a dim-lighting flag F2 for indicating not being dim-lighting to "0" (step B4). The process then proceeds to the processing according to the type of interrupt event (steps B5 to B14 of FIG. 6).

First, the CPU 11 checks whether the interrupt event is an interrupt event due to an incoming voice call (step B5) or an interrupt event due to the arrival of the day and time of an alarm (step B12) in order to determine the type of interrupt event occurring. If the interrupt event is an incoming call (step B5, YES), the CPU 11 carries out incoming call processing for a voice call (steps B6 to B11). Namely, after driving the notification unit 21 and performing incoming call notification (step B6), the CPU 11 enters an await answer state while checking for the presence or absence of an answer operation (off-hook operation) (step B7), and checking for the presence or absence of the end of an incoming call (step B7, No; step B10). When an answer operation is carried out for the incoming call (step B7, YES), the CPU 11 sets an operation flag F3 for indicating that a user operation has been carried out to "1" (step B8) and a state where calling is possible is entered (step B9). When a line connection is cut as a result of a call end operation (off-hook operation, etc.), the CPU 11 proceeds to steps B23 to B30 of the flowchart. When completion of an incoming call is detected in a call answer waiting state (step B10, YES), the operation flag F3 for indicating that a user operation has been carried out is set to "0" (step B11) and proceeds to steps B23 to B30 of the flowchart.

Figure 7:
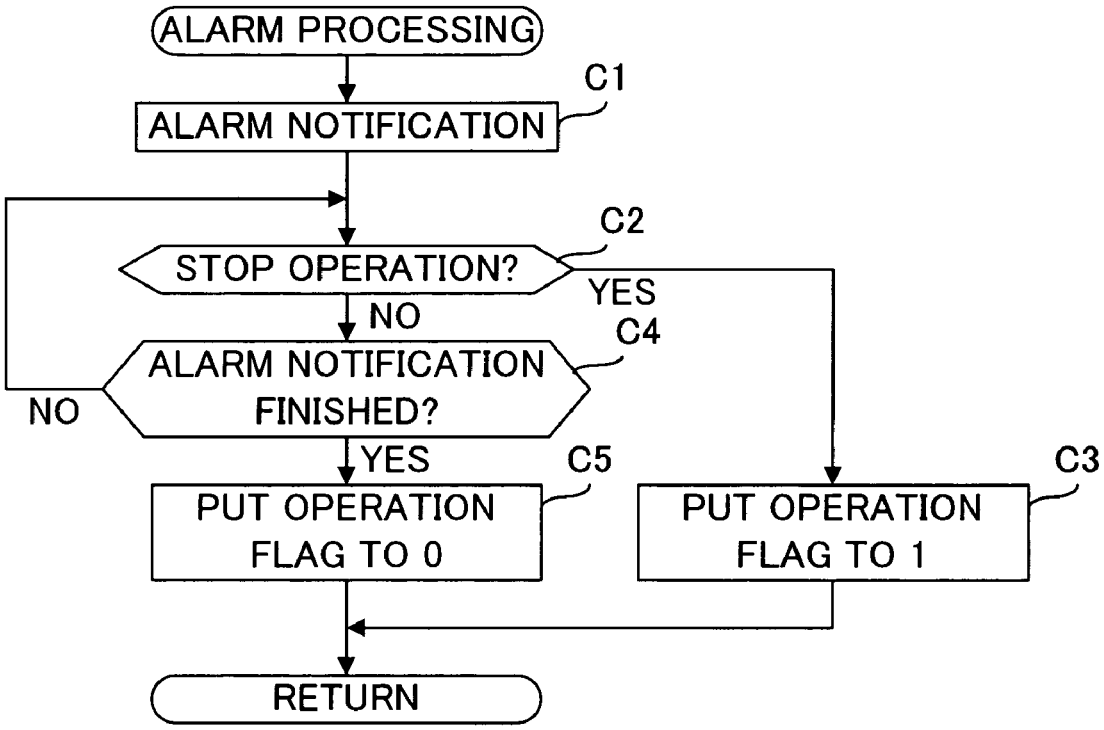
FIG. 7 is a flowchart describing alarm processing shown in FIG. 6.

If the interrupt event is an alarm (step B5, No; step B12, YES), the CPU 11 proceeds to the execution of alarm processing (step B13). FIG. 7 is a flowchart describing the alarm processing (step B13 of FIG. 6). First, in addition to driving the notification unit 21 and carrying out an alarm notification (step C1), the CPU 11 enters an operation wait state while checking for the presence or absence of an alarm stop operation (step C2) and checking for the presence or absence of completion of alarm notification (step C4). When a stop operation is carried out in this state (step C2, YES), the CPU 11 sets the operation flag F3 to "1" (step C3). With regards to this, when the alarm notification finishes without a stop operation being carried out (step C2, No; step C4, YES), the operation flag F3 is set to "0" (step C5).

Figure 8:
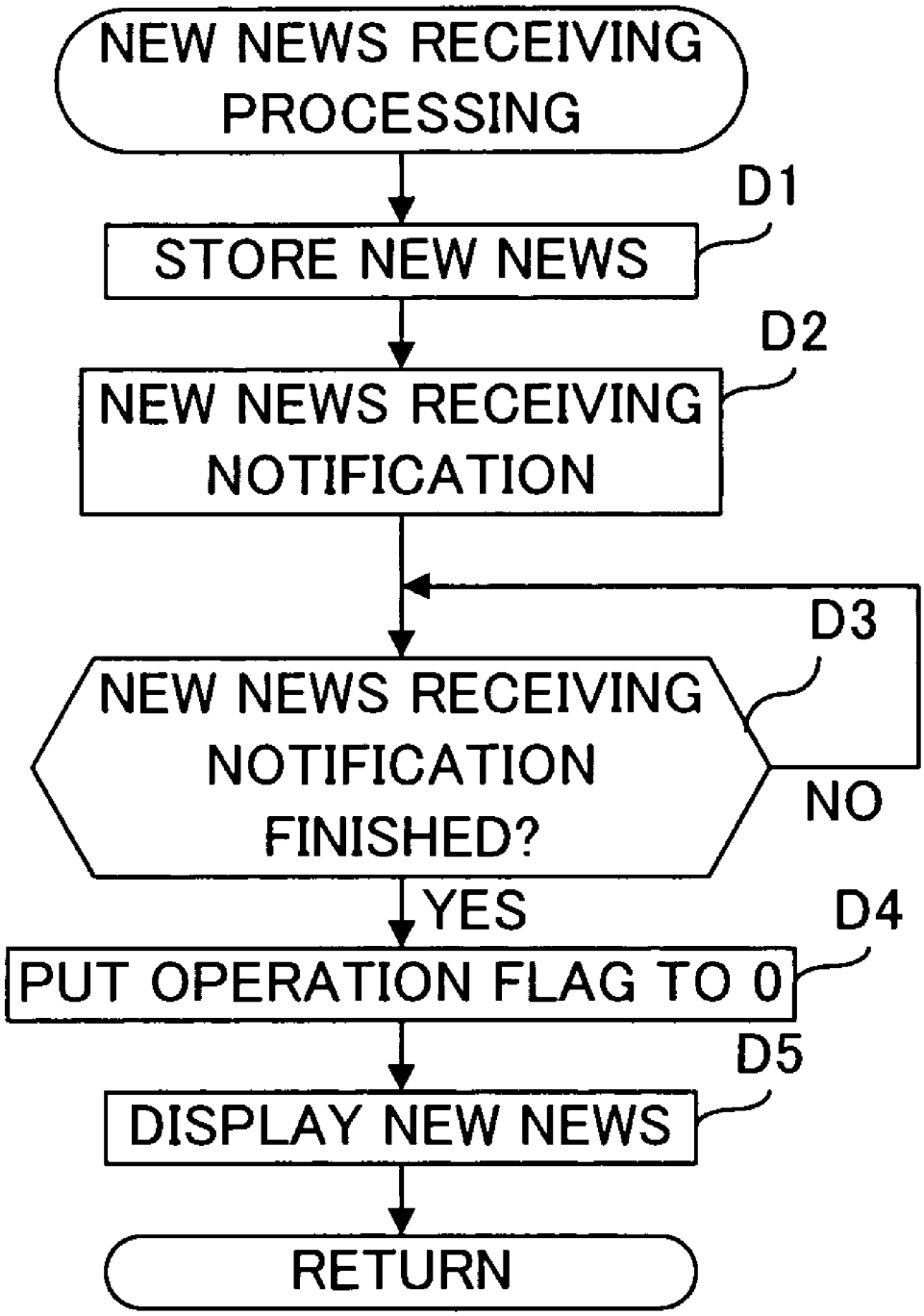
FIG. 8 is a flowchart describing new news receiving processing shown in FIG. 6.

If the interrupt event is the receipt of new news (NO in step B12 of FIG. 6), the CPU 11 proceeds to execution of new news receiving processing (step B14). FIG. 8 is a flowchart describing new news receiving processing (step B14 of FIG. 6). First, in addition to storing received new news information in the news storage unit CM (step D1), the CPU 11 drives the notification unit 21 and carries out new news receiving notification (step D2). Upon detecting the end of the new news receiving notification (step D3, YES), the CPU 11 sets the operation flag F3 to "0" (step D4) and displays the received new news information on the display unit 17 (step D5).

The CPU 11 then executes incoming call processing in accordance with the type of interrupt event (steps B5 to B11), alarm processing (step B13), and new news receiving processing (step B14). When the interrupt event ends, the CPU 11 proceeds to steps B23 to B30 of the flowchart and checks whether or not the operation flag F3 is "1", i.e. checks whether or not a user operation is carried out during interrupt execution (step B23). If the operation flag F3 is "1" (step B23, YES), the CPU 11 proceeds to the dim-lighting processing explained later (step B24). On the other hand, if the operation flag F3 is "0" (step B23, NO), the CPU 11 determines whether or not the lighting flag F1 is "1", i.e. checks whether or not an interrupt has occurred during lighting (step B25). If the dim-lighting flag F1 is "1" (step B25, YES), the CPU 11 proceeds to dim-lighting processing (step B24).

Figure 9:
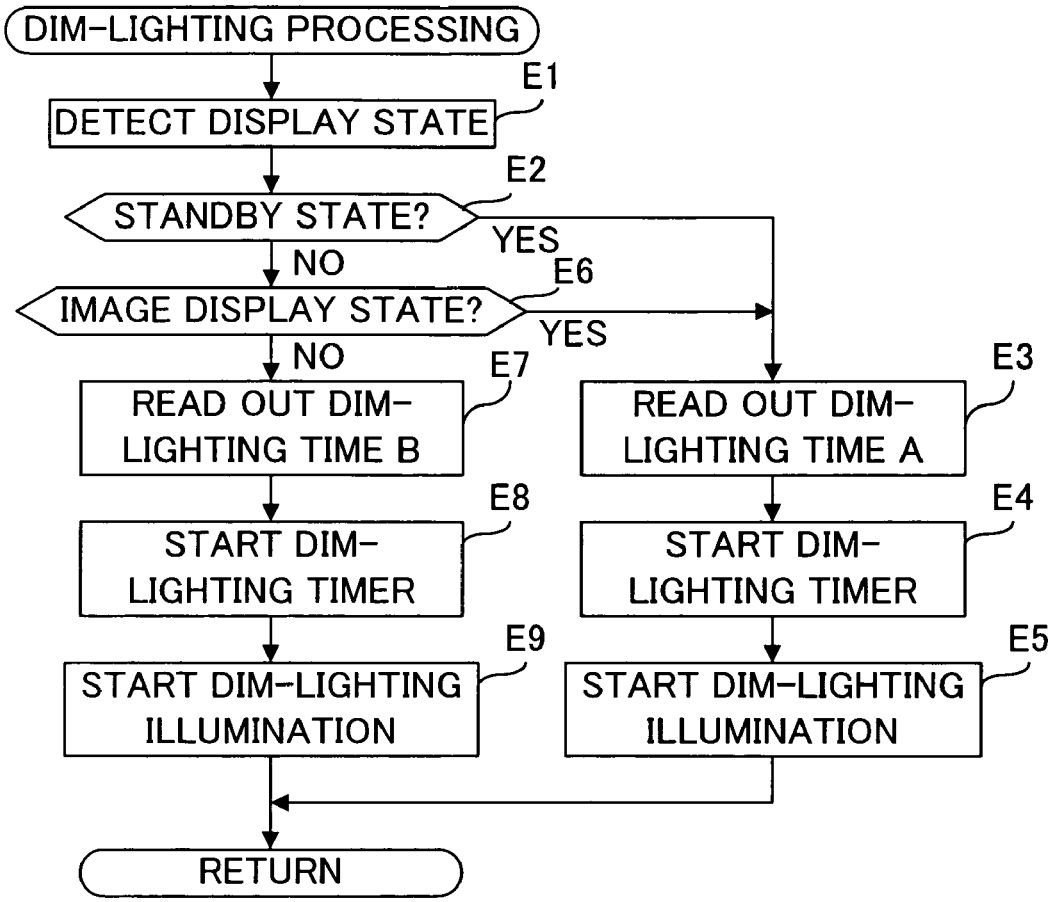
FIG. 9 is a flowchart describing dim-lighting processing shown in FIG. 6.

FIG. 9 is a flowchart describing dim-lighting processing (step A16 of FIG. 4; step B24 of FIG. 6). First, the CPU 11 detects the display state of the display unit 17 (step E1) and checks whether the display state is a standby state (step E2) or an image display state (step E6). As shown in FIG. 10A, if the display state when the interrupt ends is the standby state (step E2, YES), the CPU 11 reads out the "dim-lighting time A" from the setting information storage unit AM (step E3). This "dim-lighting time A" is preset at the dim-lighting timer T2 and the operation starts (step E4). Dim-lighting of the backlight 17B then starts (step E5). When the interrupt ends as a result, "dim lighting" is switched over to from "lighting". After this, the CPU 11 returns to step A6 of FIG. 4. At this time, when the dim-lighting timer T2 times out as a result of the "dim-lighting time A" elapsing from when the interrupt ends (step A17 of FIG. 4, YES), the CPU 11 switches over to "unlighted" from "dim-lighting", as shown in FIG. 10A (step A18).

FIG. 10B is a time chart for the case where the lighting state when the interrupt starts is "dim-lighting", i.e. when an interrupt occurs in the state of dim-lighting. In this case, in the interrupt processing of FIG. 5, because the CPU 11 detects that the lighting state when starting the interrupt is dim-lighting (step B15, YES), the CPU 11 sets the lighting flag F1 to "0" (step B16) and sets the dim-lighting flag F2 to "1" (step B17). After this, the CPU 11 detects the remaining dim-lighting time based on the "dim-lighting time A" and the value of the dim-lighting timer T2 (step B18) and temporarily stores the remaining dim-lighting time in the work region of the RAM 13 (step B19).

Namely, as shown in FIG. 10B, when the time from switching from "lighting" before the start of the interrupt to "dim-lighting" to the start of the interrupt is taken to be "elapsed dim-lighting time 't'", the value of the dim-lighting timer T2 when the interrupt starts becomes elapsed time "t". The CPU 11 obtains the value for the dim-lighting timer T2 from the "dim-lighting time A", i.e. obtains a value "A-t" where the elapsed time "t" is subtracted as the remaining dim-lighting time and temporarily stores the remaining dim-lighting time in the work region of the RAM 13. The CPU 11 then proceeds to step B20 and controls the backlight 17B to switch over from "dim-lighting" to "lighting". Thereafter, after executing processing in accordance with the type of interrupt event of FIG. 6 (steps B5 to B14), the CPU 11 proceeds to the flow of steps B23 to B30. At this time, if there is no user operation during interrupt execution (step B7, NO), the CPU 11 proceeds from step B25 to step B30.

At this time, the lighting flag F1 is set to "0" when the interrupt ends, and the dim-lighting flag F2 is set to "1" (step B25, NO; step B26, YES). The CPU 11 then reads out the remaining dim-lighting time from the work region of the RAM 13 (step B27). The remaining dim-lighting time "A-t" is then preset to the dim-lighting timer T2 and the timer operation is made to start (step B28). Dim-lighting of the backlight 17B then commences (step B29). When the interrupt ends as a result, "dim-lighting" is switched over to from "lighting". After this, the CPU 11 returns to step A6 of FIG. 4. During this time, when the dim-lighting timer T2 times out as a result of the remaining dim-lighting time "A-t" elapsing from when the interrupt ends (step A17 of FIG. 4, YES), the CPU 11 switches over from "dim-lighting" to "unlighted" as shown in FIG. 10B (step A18).

Further, if a user operation is carried out while this interrupt is executed when the lighting state at the time when an interrupt starts is dim-lighting (step B7 of FIG. 6, YES), the operation flag F3 is set to "1" (step B23, YES). The CPU 11 then proceeds to the dim-lighting processing (step B24). In this event, if the display state of when the interrupt ends is a standby state (step E2 of FIG. 9, YES), the CPU 11 presets the "dim-lighting time A" to the dim-lighting timer T2 and timer operation starts. Dim-lighting of the backlight 17B is then commenced (steps E3 to E5). Namely, the "dim-lighting time A" is preset at the dim-lighting timer T2 and switching over takes place from "dim-lighting" to "unlighted" (step A18) when the "dim-lighting time A" elapses from the time when the interrupt ends (step A17 of FIG. 4, YES).

FIG. 10C is a time chart describing the case where the lighting state at the time when the interrupt starts is "unlighted", i.e. when an interrupt occurs during unlighted. In this case, because the CPU 11 detects that the lighting state at the time when the interrupt starts is unlighted in the interrupt processing of FIG. 5 (step B2, No; step B15, NO), the lighting flag F1 is set to "0" (step B21 of FIG. 6) and the dim-lighting flag F2 is set to "0" (step B22). The backlight 17B is then controlled and is switched from "unlighted" to "lighting" (step B20). In the following, the CPU 11 executes processing in accordance with the type of the interrupt event (steps B5 to B14 of FIG. 6) and proceeds to steps B23 to B30 of the flowchart. If there is no user operation during interrupt execution (step B23, NO), the CPU 11 proceeds from step B23 to step B25. The lighting flag F1 and the dim-lighting flag F2 are set to "0" when the interrupt ends (step B25, NO; step B26, NO). The CPU 11 therefore extinguishes the backlight 17B (step B30). When the interrupt ends as a result, "unlighted" is switched over to from "lighting".

If a user operation is carried out during execution of this interrupt in the event that the lighting state when the interrupt starts is unlighted (step B7, YES), the operation flag F3 is set to "1" (step B23, YES). The CPU 11 therefore proceeds to the dim-lighting processing described above (step B24). In this event, if the display state of when the interrupt ends is a standby state (step E2 of FIG. 9, YES), the CPU 11 presets the "dim-lighting time A" to the dim-lighting timer T2 and timer operation is made to start. Dim-lighting of the backlight 17B is then commenced (steps E3 to E5). After this, the CPU 11 switches over from "dim-lighting" to "unlighted" (step A17 of FIG. 4, Yes) in the case where the "dim-lighting time A" elapses from when the interrupt ends (step A18).

On the other hand, if the display state for when the interrupt ends is an image display state (step E6 of FIG. 9, YES), the CPU 11 presets the "dim-lighting time A" to the dim-lighting timer T2 in the same way as explained above for the standby state and timer operation is made to start. Dim-lighting of the backlight 17B is then commenced (steps E3 to E5). With regards to this, if the state is a state other than the standby state or the image display state (step E6, NO), the CPU 11 reads out the "dim-lighting time B" from the setting information storage unit AM (step E7). This "dim-lighting time B" is then preset in the dim-lighting timer T2 and the timer operation is made to start (step E8). Dim-lighting of the backlight 17B is also then made to start (step E9). After this, the CPU 11 switches over from "dim-lighting" to "unlighted" when the "dim-lighting time B" elapses from when the interrupt ends (step A17 of FIG. 4, YES; step A18).

Figure 11A:
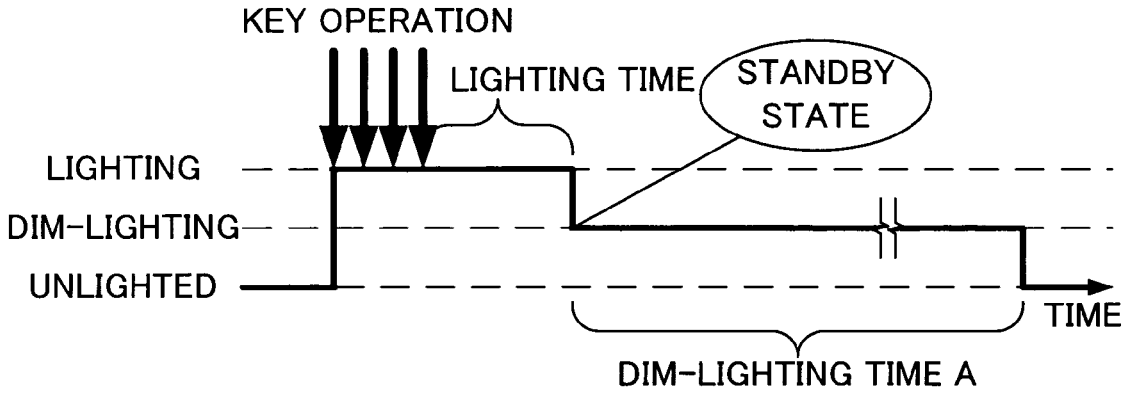
FIG. 11A is a time chart showing the lighting state of the backlight in accordance with passage of time, in the case where the display state is a standby state at the time when lighting time ends.
Figure 11B:
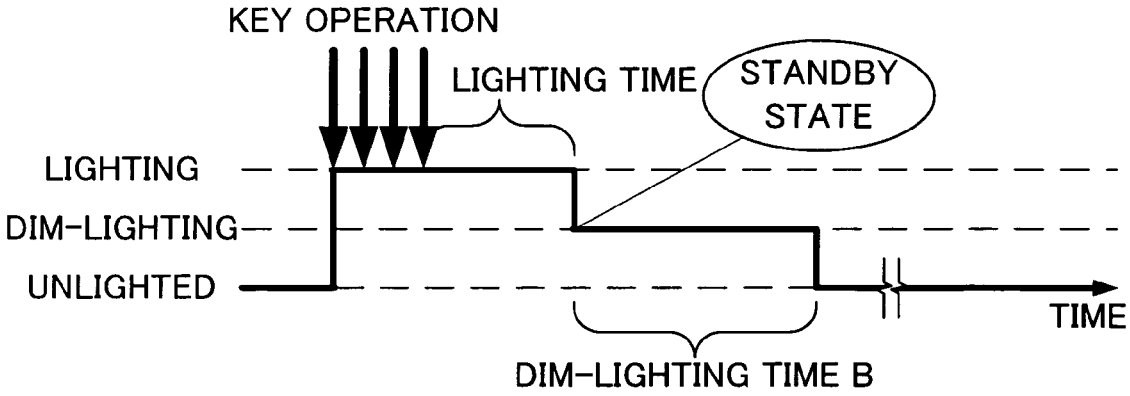
FIG. 11B is a time chart showing the lighting state of the backlight in accordance with passage of time, in the case where the display state at the time when the lighting time ends is a state other than a standby state or an image display state.

FIGS. 11A and 11B are time charts showing the lighting state of the backlight 17B before and after a user operation, in accordance with the passage of time. FIGS. 11A and 11B show how the lighting state is controlled depending on whether the display state when the lighting time ends is a standby state, an image display state, or a state other than the standby state/image display state. FIG. 11A is the case where the display state when the lighting time ends is the standby state. In this event, in response to a user operation (step A10 of FIG. 4, YES), the CPU 11 presets the "lighting time" to the lighting timer T1 and starts the timer operation. The CPU 11 also starts lighting of the backlight 17B (steps A11 to A13). The CPU 11 then continues with this lighting state until timing out of the lighting timer T1 is detected (step A15).

When timing out of the lighting timer T1 is detected (step A15, YES), the CPU 11 proceeds to the dim-lighting processing of FIG. 9 (step A16). During this time, because the CPU 11 detects that the display state for the end of the lighting time is a standby state (step E2 of FIG. 9), the CPU 11 presets the "dim-lighting time A" to the dim-lighting timer T2 and causes the timer operation to start. Dim-lighting of the backlight 17B is also then made to start (steps E3 to E5). After this, when the "dim-lighting time A" elapses and the dim-lighting timer T2 times out (step A17 of FIG. 4, YES), the CPU 11 switches over from "dim-lighting" to "unlighted" as shown in FIG. 11A (step A18).

FIG. 11A is a time chart describing the case where the display state at the time when the lighting time ends is a state other than the standby state/image display state. In this event, when there is a response to a user operation and the lighting time from the start of lighting ends, the CPU 11 proceeds to dim-lighting processing (steps A10 to A16 of FIG. 4). During this time, because the CPU 11 detects that the display state for the end of the lighting time is a state other than the standby state/image display state (No in step E6 of FIG. 9), the CPU 11 presets the "dim-lighting time B" in the dim-lighting timer T2 and causes the timer operation to start. Dim-lighting of the backlight 17B is also then made to start (steps E7 to E9). After this, when the "dim-lighting time B" elapses (steps A17 of FIG. 4, YES), the CPU 11 switches over from "dim-lighting" to "unlighted" (step A18).

As shown above, in this embodiment, the CPU 11 lights or extinguishes the display unit 17 after the end of the interrupt event in accordance with the lighting state (lighting, dim-lighting, unlighted) of the display unit 17 when an occurrence of an interrupt event is detected. It is therefore possible for the CPU 11 to perform appropriate display control according to the lighting state when an interrupt event occurs.

If the occurrence of an interrupt event is detected while unlighted, the CPU 11 extinguishes the display unit 17 after the end of the interrupt event. When, for example, there is then an incoming call while unlighted, the display unit 17 is extinguished after completion of arrival etc., and control according to the actual conditions is possible. Namely, cases where the mobile telephone is not used for a long time are common when the display unit 17 is unlighted. In such an event, the CPU 11 ensures that the display unit remains unlighted and does not light or dimly light the display unit 17 every time an interrupt event ends. It is therefore possible to prevent unnecessary power consumption.

If the occurrence of an interrupt event is detected during the state of lighting, the CPU 11 controls the display unit 17 to dimly light after the end of the interrupt event. This means that, for example, when an incoming call takes place during lighting, control, such as dim-lighting after the end of the incoming call, is possible according to actual conditions. Namely, the user can sufficiently confirm display contents even with dim-lighting after the end of an interrupt event. As a result, the CPU 11 can prevent unnecessary consumption of power because it is not necessary to light the display unit 17.

If dim-lighting is taking place when the occurrence of an interrupt event is detected, the CPU 11 dimly lights the display unit 17 after the end of the interrupt event. Control, for example, according to actual conditions such as dim-lighting after an incoming call ends when there is an incoming call when the lighting state is dim-lighting is therefore possible. Namely, the user can sufficiently confirm display contents even with dim-lighting after the end of an interrupt event. As a result, the CPU 11 can prevent unnecessary consumption of power because it is not necessary to control the display unit 17 to light.

If dim-lighting is taking place when the occurrence of an interrupt event is detected, the CPU 11 takes a value for the dim-lighting timer T2 for up to the occurrence of the interrupt event as a dim-lighting elapsed time "t" and obtains "A-t" by subtracting the dim-lighting elapsed time "t" from the "dim-lighting time A" as the remaining dim-lighting time occurring after the end of the interrupt event. The CPU 11 then controls the display unit 17 to dimly light for just the remaining time. As a result, it is possible to prevent unnecessary power consumption because it is not necessary for the CPU 11 to dimly light the display unit 17 for a long time every time an interrupt event ends but rather is sufficient to dimly light just for the remaining dim-lighting time even when the dim-lighting time is set to a long time such as thirty minutes or one hour.

When a user operation is carried out against an interrupt event occurring during the state of unlighted, i.e. when being used by the user, the CPU 11 controls the display unit 17 to dimly light after the end of the interrupt event. This display content can therefore be confirmed by the user. For example, when there is an incoming call during the state of unlighted and the incoming call is answered, it is possible for the user to confirm the display contents as a result of dim-lighting after the call ends.

When a user operation is not carried out against the interrupt event occurring when unlighted, i.e. when the mobile telephone 1 is not in use by the user, the CPU 11 controls the display unit 17 to extinguish after the end of the interrupt event. It is therefore possible to prevent unnecessary power consumption.

The CPU 11 controls the dim-lighting time according to the display state of the display unit 17 when starting dim-lighting. It is therefore possible to appropriately control displaying according to the display state when starting dimly lighting.

The CPU 11 controls the display unit 17 to dimly light for a longer time when the display state of the display unit 17 is in a standby state at the time when starting dimly lighting than in the case of other states. It is therefore possible for the user to confirm this display content for a longer time. Many recent mobile telephones, for example, display moving images on the standby screen that tell a story; in addition to being capable of showing this kind of display content to a user for a long time, the mobile telephone is also capable of making the dim-lighting time to be relatively short in cases other than the standby state. It is therefore possible to prevent unnecessary power consumption.

The CPU 11 controls the display unit 17 to dimly light for a longer time when the display state of the display unit 17 is in an image display state such as displaying moving images and still images at the time when starting dimly lighting than in the case of other states. It is therefore possible for the user to confirm this display content for a longer time. In addition to, for example, being capable of displaying display content such as a movie playback function or a television viewing broadcast to the user, the CPU 11 can also make the dim-lighting time relatively short in cases other than the image display state and it is possible to prevent unnecessary power consumption.

In the above-described embodiment, an arbitrary lighting time selected from a selection range of "zero seconds to sixty seconds" is set at the "lighting time", and dim-lighting times arbitrarily selected from with selection ranges of "zero minute to ninety minutes" or "zero minute to five minutes" and are set at the "dim-lighting time A" and the "dim-lighting time B". However, the present invention is not limited to this, and any length of time can be inputted through user operations and set at the "lighting time", the "dim-lighting time A", and the "dim-lighting time B". In a possible embodiment "lighting time", "dim-lighting time A" and "dim-lighting time B" may be preset and a selection by a user operation may not be allowed.

In the above embodiment, an incoming voice call, an alarm, or the receipt of new news are described as the interrupt events, but the present invention is not limited to these, and the receipt of e-mail, a voltage low alarm, or an out of range alarm may be eligible. In the above-described embodiment, image data stored in the image data storage unit DM is still images or moving images but the present invention is by no means limited in this respect, and moving images received as the result of the broadcast of television pictures etc. are also possible.

In the above-described embodiment, if there is a user operation during an interrupt in the case where an interrupt event occurs during dim-lighting, the CPU 11 switches over to dim-lighting for the "dim-lighting time A" directly after the end of the interrupt. The present invention is, however, not limited to these. It is also possible for the CPU 11 to switch over to dim-lighting for the "dim-lighting time A" after carrying out "lighting" for the "lighting time" from the time the user operation is carried out without waiting for the end of the interrupt.

Similarly, in the above-described embodiment, the CPU 11 switches over to dim-lighting of the "dim-lighting time A" directly after the end of the interrupt if a user operation is carried out during an interrupt when the interrupt event occurs when unlighted. The present invention is, however, not limited to this respect. It is also possible for the CPU 11 to switch over to dim-lighting for the "dim-lighting time A" after carrying out "lighting" for the "lighting time" from the time the user operation is carried out without waiting for the end of the interrupt.

In the above-described embodiment, the brightness of the display unit 17 is controlled using three levels of "lighting", "dim-lighting", and "unlighted". However, the present invention is by no means limited in this respect, and control can be exerted using four levels or more. In the above embodiment, a description is given where the display unit 17 is taken to be a light-receiving type device such as a liquid crystal display device but the present invention is by no means limited in this respect. For example, the display unit 17 can be an arbitrary device such as a light-emitting type device such as an organic EL providing that control of the brightness due to the emitted light to "lighting" and "dim-lighting" is possible. In addition, in the above-described embodiment, the terminal apparatus is a mobile telephone but the present invention is not limited to this and the terminal apparatus can also be, for example, an arbitrary apparatus such as a personal computer, PDA (Personal Digital Assistant), digital camera, or electronic player.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2007-294019 filed on Nov. 13, 2007, and including specification, claims, drawings and summary. The disclosure of the above Japanese Patent Application is incorporated herein by reference in its entirety.

What is claimed is:

1. A terminal device for controlling a display unit to be in a lighting state of at least one of lighting at a first brightness, lighting at a second brightness darker than the first brightness, and being unlighted, the terminal device comprising:

an event detection unit that detects an occurrence of an interrupt event;

a lighting detection unit that detects the lighting state of the display unit; and a lighting control unit that exerts control so that the lighting state of the display unit is either one of the second brightness or being unlighted after the end of the interrupt event by referring to the lighting state detected by the lighting detection unit when the occurrence of the interrupt event is detected by the event detection unit.

2. The terminal device according to claim 1, wherein if the lighting state detected by the lighting detection unit when the occurrence of the interrupt event is detected by the event detection unit is being unlighted, the lighting control unit exerts control so that the display unit is being unlighted after the end of the interrupt event.

3. The terminal device according to claim 1, wherein if the lighting state detected by the lighting detection unit when the occurrence of the interrupt event is detected by the event detection unit is lighting at the first brightness, the lighting control unit exerts control so that the display unit is lighting at the second brightness after the end of the interrupt event.

4. The terminal device according to claim 1, wherein if the lighting state detected by the lighting detection unit when the occurrence of the interrupt event is detected by the event detection unit is lighting at the second brightness, the lighting control unit exerts control so that the display unit is lighting at the second brightness after the end of the interrupt event.

5. The terminal device according to claim 4, further comprising: a setting unit that sets a lighting time for the second brightness; and a time detection unit that detects elapsed lighting time for the second brightness, wherein if the lighting state detected by the lighting detection unit when the occurrence of the interrupt event is detected by the event detection unit is lighting at the second brightness, the lighting control unit controls lighting time at the second brightness after the end of the interrupt event based on the lighting time set by the setting unit and the elapsed lighting time detected by the time detection unit.

6. The terminal device according to claim 1, further comprising an operation detecting unit that detects whether or not a user operation has been carried out for the interrupt event, wherein the lighting control unit exerts control so that the display unit is lit at the second brightness after the end of an operation corresponding to the user operation in a case where the lighting state detected by the lighting detection unit when the occurrence of the interrupt event is detected by the event detection unit is being unlighted and performance of a user operation is detected by the operation detection unit.

7. The terminal device according to claim 1, further comprising an operation detection unit that detects whether or not a user operation is carried out for the interrupt event, wherein the lighting control unit exerts control so that the display unit is unlighted after the end of the interrupt event in a case where the lighting state detected by the lighting detection unit when the occurrence of the interrupt event is detected by the event detection unit is being unlighted and the operation detection unit detects that a user operation is not carried out.

8. A non-transitory computer-readable storage medium that stores a program for implementing:

a function that detects an occurrence of an interrupt event;

a function that detects a lighting state of a display unit as a lighting state of at least one of lighting at a first brightness, lighting at a second brightness darker than the first brightness, and being unlighted; and a function that controls the lighting state of the display unit to be one of the lighting at the second brightness or being unlighted after the end of the interrupt event by referring to the lighting state detected when the occurrence of the interrupt event is detected, on a computer.

* * * * *